US005696424A

United States Patent [19]

Coushaine

[11] Patent Number: 5,696,424

[45] Date of Patent: Dec. 9, 1997

[54] ALIGNMENT STRUCTURE FOR HEADLAMP CAPSULE

[75] Inventor: Charles M. Coushaine, Rindge, N.H.

[73] Assignee: Osram Sylvania Inc., Danvers, Mass.

[21] Appl. No.: 720,255

[22] Filed: Sep. 26, 1996

[51] Int. Cl.[6] ..... H01J 5/48; H01R 33/00

[52] U.S. Cl. ..... 313/318.1; 313/113; 313/318.9; 313/318.01; 362/226; 362/306; 439/619

[58] Field of Search ..... 313/318.01, 318.05, 313/318.07, 318.09, 318.12, 318.11, 318.1, 113, 315; 362/226, 306; 439/619, 611

[56] References Cited

U.S. PATENT DOCUMENTS

| | | | |
|---|---|---|---|
| 4,396,860 | 8/1983 | Hellwig et al. | 313/318.09 |
| 4,473,770 | 9/1984 | Baba et al. | 313/318.12 |
| 4,569,005 | 2/1986 | Bergin et al. | 313/113 |
| 4,623,958 | 11/1986 | Van der Linde et al. | 313/113 |
| 4,719,543 | 1/1988 | Coliandris | 362/80 |
| 4,751,421 | 6/1988 | Braun et al. | 313/318 |
| 5,420,474 | 5/1995 | Schmitt, Jr. et al. | 313/318.1 |

*Primary Examiner*—Michael Horabik
*Assistant Examiner*—Michael Day
*Attorney, Agent, or Firm*—William E. Meyer

[57] ABSTRACT

A replaceable headlamp lamp bulb may be held in retainer with a projecting tab. The tab may in turn be positioned in a slotted holder having adjacent pivots. The lamp bulb may then be positioned by sliding and pivoting the tab with respect to the slot and pivots until properly located. The tab may then be welded to the adjacent slot wall, thereby accurately and permanently fixing the lamp in three dimensions. The slotted holder may be retained in a less expensive resin, since ultrasonic welding is no longer required.

8 Claims, 4 Drawing Sheets

ALIGNMENT STRUCTURE FOR HEADLAMP CAPSULE

TECHNICAL FIELD

The invention relates to electric lamps and particularly to support and alignment structures for electric lamps. More particularly the invention is concerned with a support and alignment structure for a vehicle headlamp capsule.

BACKGROUND ART

Replaceable headlamp capsules are commonly made with a lamp bulb held in a holder. To achieve proper optical positioning, the bulb must be accurately located with respect to the holder. The bulb holder is then accurately located with respect to the reflector. There have been numerous methods for achieving this. The most frequent technique is to clamp the bulb in a metal retainer. The metal retainer is then rotated or pivoted with respect to the plastic holder. Once the bulb and retainer are properly positioned, the retainer is ultrasonically welded to the plastic holder. The plastic materials that have been used as holders must withstand the environmental conditions typical of a headlamp (vibration, heat, cold, water, chemicals), and retain their insulating character over many years of service. They must also be easily, and accurately molded, and ultrasonically weldable. The result is these plastic materials are necessarily, relatively expensive. Unfortunately, in terms of volume, the plastic holder is the largest item. To reduce overall lamp costs there is a need to use alternative materials, that are less expensive, but these less expensive materials cannot have the same functional characteristics. There is then a need for a headlamp capsule positioning method that does not rely on expensive holder materials.

DISCLOSURE OF THE INVENTION

A headlamp capsule may be formed with a lamp bulb having an axis and a press sealed end with one or more electric leads extending through the press seal. A retainer is coupled to the lamp bulb adjacent the press seal, the retainer having at least one planar side tab projecting outward from the retainer. The retainer tab is positioned in at least one support having a first side wall and a second side wall defining an elongated, axially extending slot there between, with the defined slot being sized and shaped to receive the side tab therein. The first side wall being further formed to have a first pivot, the second side wall may be similarly formed with a second pivot. The side tab is positioned between the first pivot and the second pivot and joined to the support along at least one side wall. A holder fixedly holds the support; and at least one electrical connector is passed through the holder and electrically coupled to one or more lamp leads, with electrical connectors otherwise formed and positioned to receive electric power for the lamp bulb.

BEST MODE FOR CARRYING OUT THE INVENTION

Figure 1:
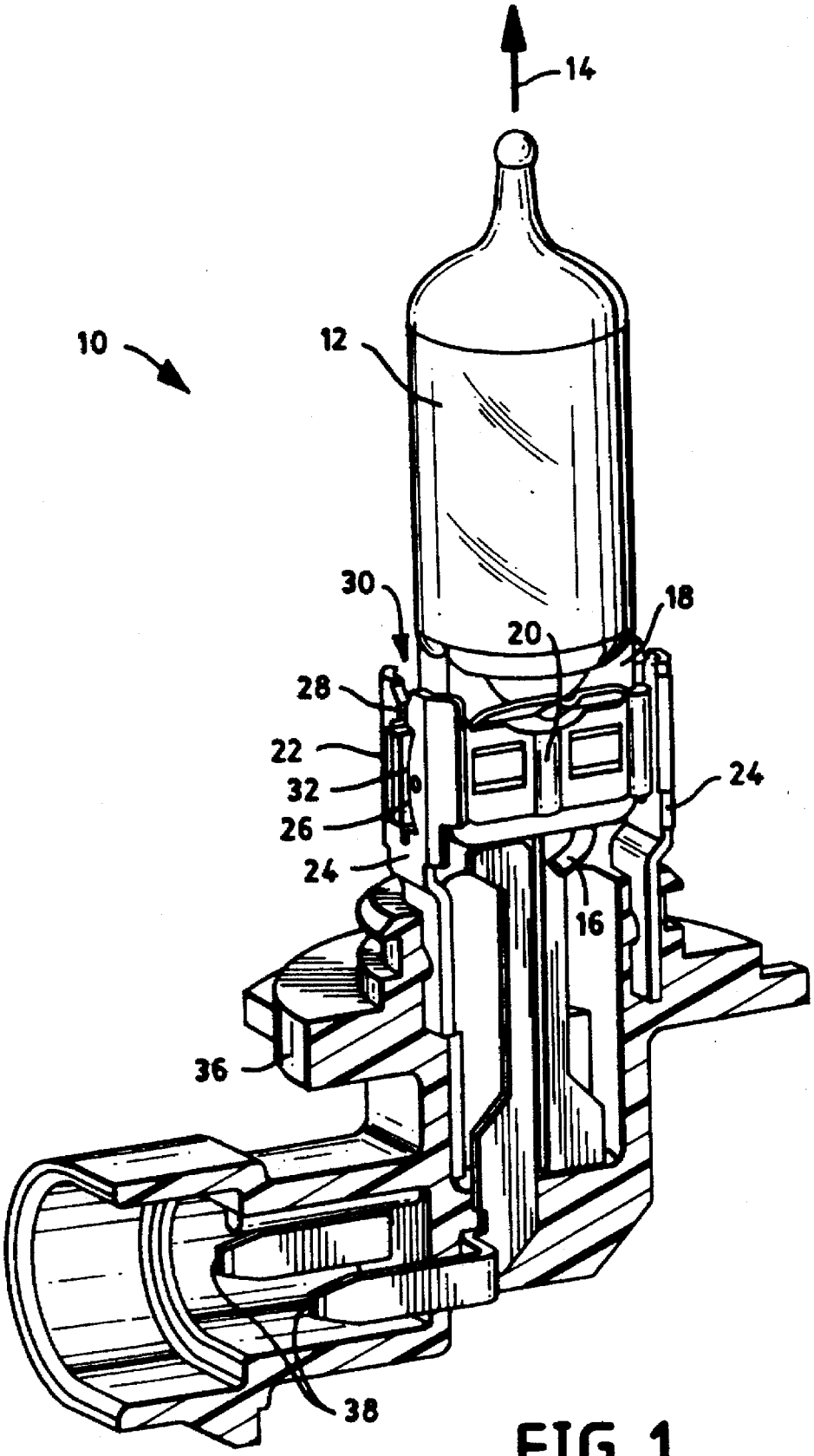
FIG. 1 shows a side view of a preferred embodiment of a headlamp capsule, partially sectioned.

FIG. 1 shows a preferred embodiment of a headlamp capsule 10. Like reference numbers designate like or corresponding parts throughout the drawings and specification. A headlamp capsule 10 is made with a lamp bulb 12, a retainer 20, a support 24, a holder 36 and an electrical connector 38. The lamp bulb 12 may be any glass or quartz envelope enclosing a light source. An axis 14 extends from one end of the lamp bulb 12 to the other, roughly passing through the light source. One end of the envelope is press sealed with one or more electric leads 16 extending through a seal 18, thereby providing electrical connection to the enclosed light source. The preferred lamp bulb 12 is a aluminasilicate glass or quartz tube enclosing a tungsten halogen light source with two leads 16 passing through the seal 18. The preferred seal 18 is an approximately flattened end region of a tubular envelope. It is know in the art to form protuberances or indentations in the seal 18 to enable or enhance coupling or proper location of the lamp bulb 12 with respect to a retainer 20. Adjacent, and firmly coupled to the seal 18 is the retainer 20. The preferred retainer 20 is a metal band encircling and holding the lamp bulb 12 at the seal 18. The band may be formed by welding at each end, two pieces fitting around the seal 18. The preferred retainer 20 includes two side tabs 22 that extend away from the lamp bulb 12, and are roughly parallel to the plane of the seal 18. The side tabs 22 can have flat faces, and are preferably co-planar with each other.

Figure 2:
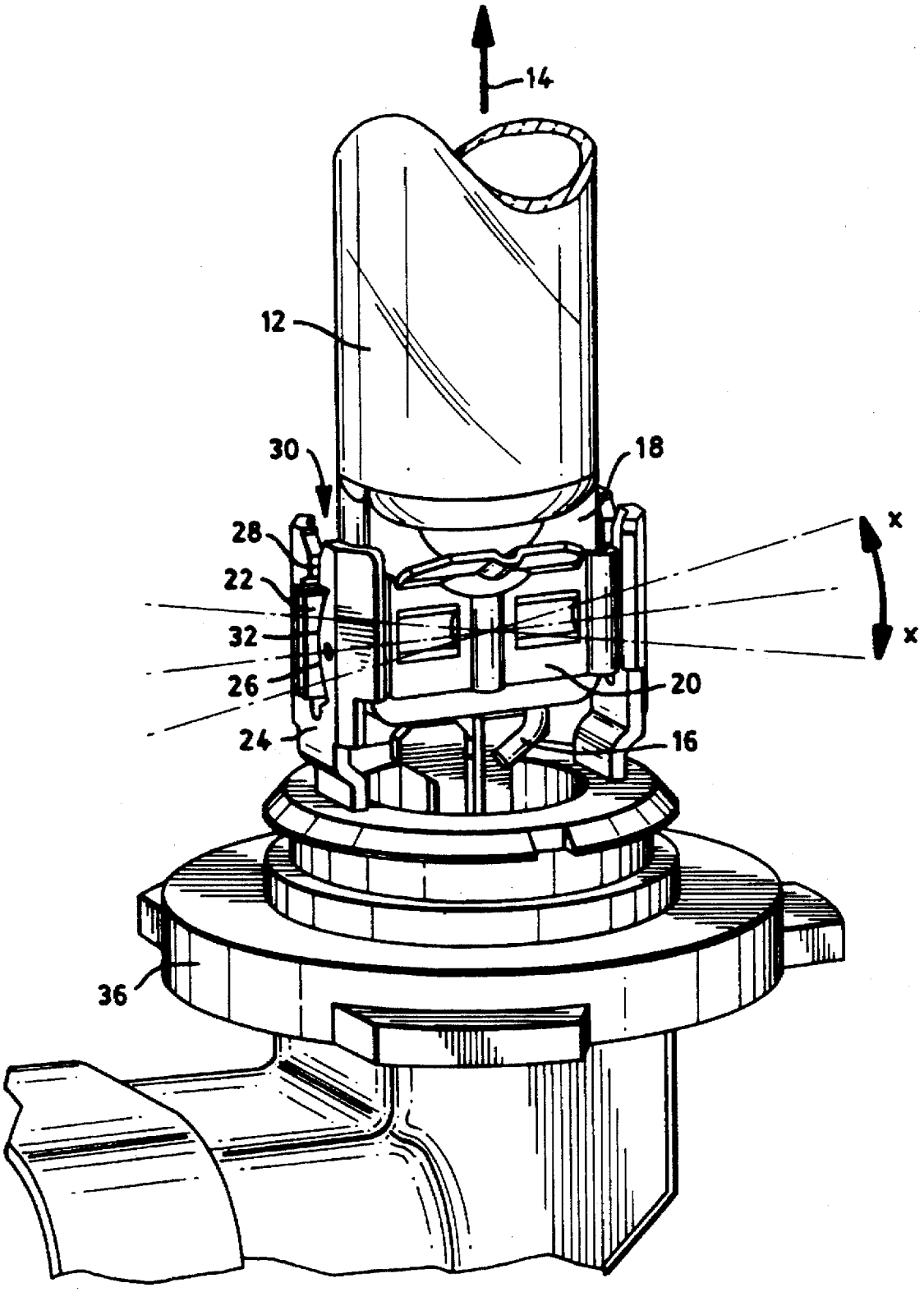
FIG. 2 shows an side perspective view of a preferred embodiment of a headlamp capsule, partially broken away.
Figure 3:
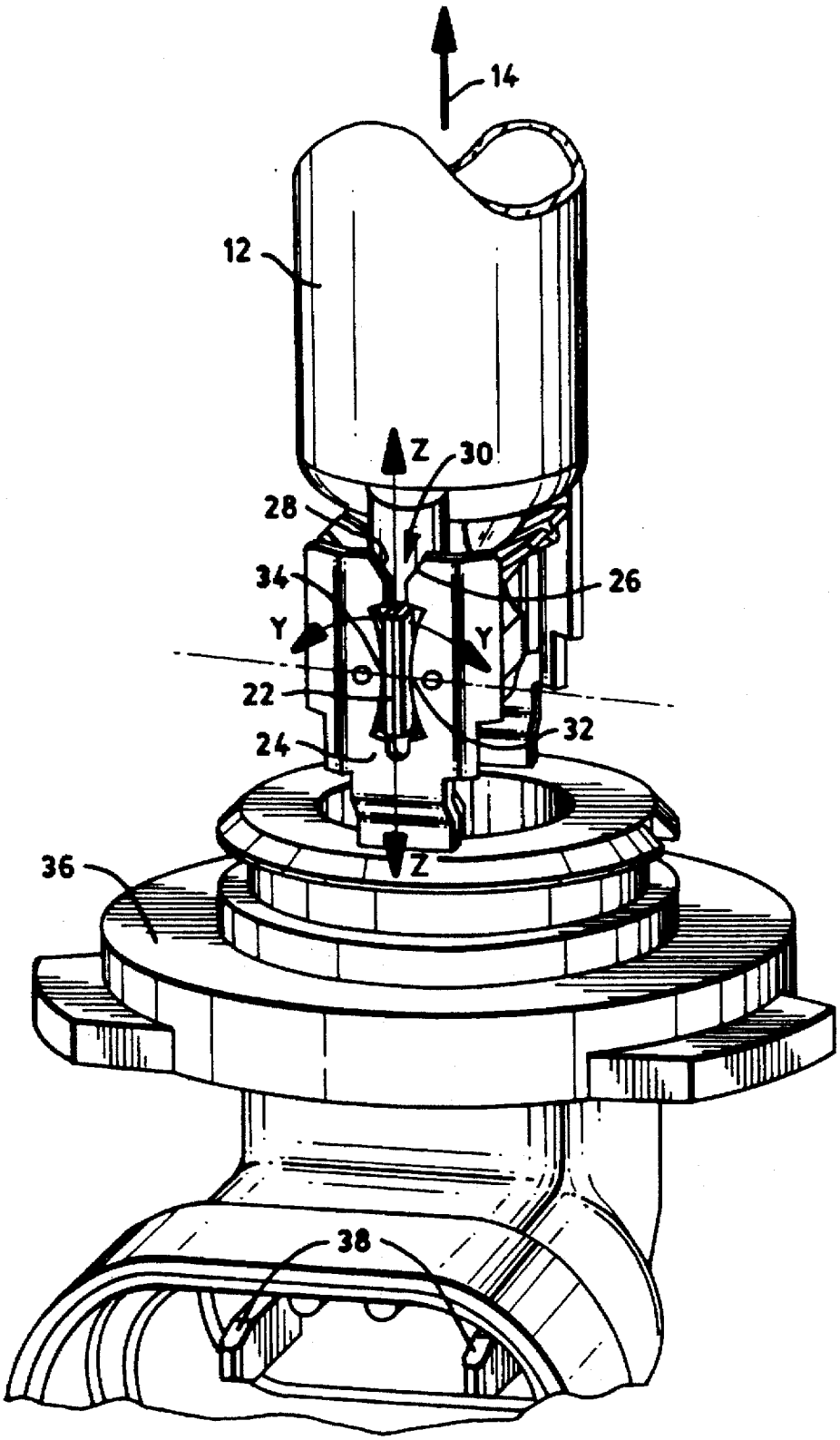
FIG. 3 shows an end perspective view of a preferred embodiment of a headlamp capsule, partially broken away.

Turning to FIG. 2, and FIG. 3, adjacent the retainer 20, in the region of the side tabs 22 are supports 24. The supports 24 are made of metal, and are sufficiently strong to securely support the lamp bulb 12 and retainer 20. At least one support 24 has a first side wall 26 and a second side wall 28 defining an elongated, axially extending slot 30 there between. The slot 30 is sized and shape to receive the adjacent side tab 22 therein. The side wall 26 is further formed to have a first pivot 32. The pivot 32 may be a projecting point or a convex surface. The preferred pivot 32 is a smoothly convex edge of the side wall 26, for example a circular section formed on the edge of the side wall 26. In the preferred embodiment, formed on similar side wall 28 may be a similar second pivot 34. The flat face of the side tab 22 can be placed against the first pivot 32. The side tab 22 can slide in the axial direction 14 along the first pivot 32 while remaining in the slot 30. This allows adjustment of the lamp bulb 12 in the Z direction. The side tab 22 can also be rocked side to side in a plane roughly including the lamp axis 14 and a point along the pivot 32 (or second pivot 34) and thereby passing through the slot 30. This allows adjustment of the lamp bulb 12 in the X direction (FIG. 2). The side wall 26 is also sloped, or curved away from the first pivot 32 on the upper and lower sides of the first pivot 32. The slot 30 then has greater width above and below the first pivot 32. The lamp bulb 12 can then be pivoted as side tab 22 turns about the first pivot 32. This moves the lamp bulb 12 in a plane including the lamp axis 14, and roughly parallel to a plane extending between the side walls 26 and 28. This allows adjustment of the lamp bulb 12 in the Y direction (FIG. 3).

Figure 4:
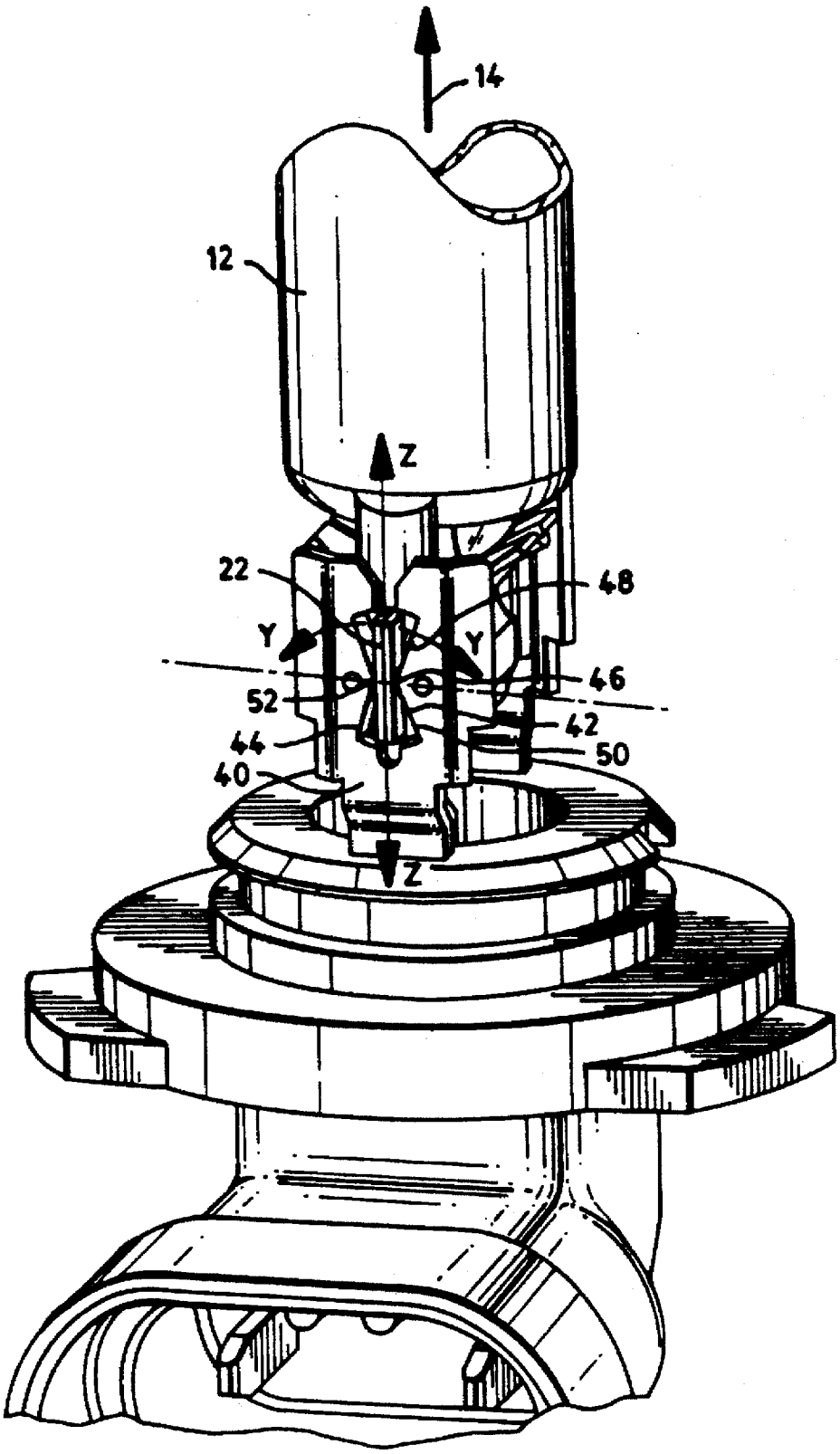
FIG. 4 shows an end perspective view of an alternatively preferred embodiment of a headlamp capsule, partially broken away.

FIG. 4 shows an end perspective view of an alternatively preferred embodiment of a headlamp capsule, partially broken away. In the alternative construction, a support 40 includes side walls 42 and 44. Side wall 42 is formed with a single pivot 46. Extending from pivot 46 on each side (above and below) are two straight ramps 48, 50. A side tab 22 may pivot on pivot point 46. The preferred support 40 includes a similarly formed second side wall 44 being formed with a similar single pivot 52. The side tab 22 is positioned between the first pivot 46 and the second pivot 52. When the lamp bulb 12 is properly aligned, by sliding axially (Z direction, FIG. 3), rocking side to side orthogonaly to the axis 14 (X direction, FIG. 2), and pivoting orthogonaly to the axis 14 (Y direction, FIG. 3), the side tab 22 is then fixed in place, for example to an adjacent side wall pivots 46, or 52, as the case may be. The preferred way of joining the retainer 20 and the side tabs 22 is to weld the retainer 20 at side tab 22 to the support 24 (or 40) at the pivot point (e.g. 32 or 46), while holding the lamp bulb 12 in the proper X, Y, and Z orientation.

The support 24 is fixed in a holder 36 by molding it in place, driving it into a formed hole or by other known methods. A similar support structure may be formed to support the second side tab, again held by holder 36. There are numerous shapes and designs for holders 36. The preferred holder 36 is a filled plastic resin body retaining extended ends of the supports 24. The holder 36 has the general form of a bayonet coupling as is generally known in the art. Sealing, alignment, latching and other features may be formed in the holder 36 as generally known in the art. The preferred holder 36 includes bayonet latching features, and an O-ring seal and O-ring groove. At least one, and preferably two of the lamp leads 16 are extended through the holder 36 to electrically couple to the connectors 38. At least one electrical connector 38 is held in the holder 36 and electrically coupled to a lamp lead 16. In the preferred embodiment the connectors 38 are molded or staked in the holder 36. The electrical connectors 38 are otherwise formed and positioned to receive electric power for the lamp bulb 12, for example as a plug type connector.

The lamp bulb 12 is aligned by first inserting the side tabs 22 between the slots 30 in the supports By moving the lamp bulb 12 axially, (Z direction), the side tabs 22 can be moved in parallel between the support's side walls 26, 28, but the side tabs 22 remain close to, or in contact pivots 32 or 34.

The proper Z position of the filament can then be found. By rocking the lamp axis 14 side to side in a plane passing through the lengths of the support 24 and slots 30, the side tabs 22 can then be moved side to side in the slots 30. The X direction of the lamp source can then be properly located, but again the side tabs 22 remain close to, or in contact with one of the pivots 32, or 34. Pivoting the lamp bulb 12 in the Y plane (including the lamp axis 14 but orthogonal to the X plane), the side tabs 22 can be rotated along the side walls 26, or 28, while remaining abutted against pivot 32 (or alternatively pivot 46), thereby setting the Y coordinate of the light source. Again the side tabs 22 remain close to the one or both of the pivots 32, 34 as the case may be. Geometrically, if the slots 30 are snug with the side tabs 22, rotation of the lamp bulb 12 in the Y plane could cause the side tabs 22 to progressively press against the supports 24, thereby spreading them, but also providing a spring force that could reorient the lamp bulb 12, after being released from the welding process. In fact, the lamp bulb 12 rotation typically needs less than three degrees rotation to achieve proper orientation. Further, there is a small manufacturing tolerance gap between the side tabs 22 and the supports 24. This is the result of ordinary manufacturing tolerances allowed in the parts manufacture. The small angle of rotation, can then be absorbed by the small tolerance gap between the side tabs 22, and the side walls 26, 28. Once in proper position the side tab 22 with respect to support 24 is achieved, the lamp bulb 12 is fixed in place, for example by welding the side tab 22 to the adjacent pivot 26 (28, 46 or 48 as the case may be). Once the lamp is properly oriented, the side tabs 22 can be welded to side walls 26 or 28. In particular, the side tabs 22 can be partially fused to weld a portion of the side tab 22 or tabs to the first pivot 32. The lamp bulb 12 is then properly aligned and permanently locked in place.

In a working example, the lamp capsule was made of aluminasilicate glass, and had a single press sealed end with two electric leads extending from the press seal. The retainer was made of two pieces of stainless steel, joined by welding at each end, two end tabs thereby forming the extending side tabs. The retainer then formed a strap encircling the press seal with two side projecting tabs. The tabs had a width of 6.35 millimeters (0.25 inch) and a thickness of 0.457 millimeter (0.018 inch). The holder was made of two stainless steel forks extending approximately parallel to the lamp axis. Each fork had a first and second tine portion each with a convex circular section extending in the direction of the adjacent tine. The circular sections provided pivot edges that a side tab could slide, rock and pivot against. The holder was made of a high temperature plastic (Amodel), and had latching, sealing, and electrical connection features as are generally known in the field. The disclosed operating conditions, dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A headlamp capsule comprising:

a lamp bulb having an axis and a press sealed end with one or more electric leads extending through the press seal; a retainer coupled to the lamp bulb adjacent the press seal, the retainer having at least one planar side tab projecting outward from the retainer; at least one support having a first side wall and a second side wall defining an elongated, axially extending slot there between, the defined slot being sized and shape to receive the side tab therein, the first side wall being further formed to have a projecting first pivot, the side tab being positioned adjacent the first pivot for pivotal adjustment of the side tab with respect to the the pivot, and thereafter the side tab being joined to the support along at least one side wall; a holder fixedly holding the support; and at least one electrical connector held in the holder and electrically coupled to the lamp lead, the electrical connectors formed and positioned to receive electric power for the lamp bulb.

2. The lamp in claim 1 wherein the first side wall includes a smoothly curved pivot surface.

3. The lamp in claim 1 wherein the first side wall has a straight ramped section leading up to the first pivot.

4. The lamp in claim 1 further including a second side wall with a second pivot first pivot, with the side tab positioned between the first side wall and the second side wall.

5. The lamp in claim 4 wherein the side tab is adjacent the first pivot, and adjacent the second pivot.

6. The lamp in claim 4 wherein the first side wall and the second side wall are shaped with mirror images of each other with respect to a medial plane through the side tab.

7. The lamp in claim 1 wherein the retainer has a similarly formed second side tab extending approximately coplanar to the first side tab, and similarly coupled to a similarly formed second support.

8. The lamp in claim 1, wherein the side tab is welded to at least one of the side walls.

* * * * *